United States Patent [19]

Suarez

[11] 4,150,247

[45] Apr. 17, 1979

[54] STUB DESIGN FOR ESR ELECTRODES

[75] Inventor: Francis S. Suarez, Huntington, W. Va.

[73] Assignee: Huntington Alloys, Inc., Huntington, W. Va.

[21] Appl. No.: 912,221

[22] Filed: Jun. 5, 1978

[51] Int. Cl.[2] ..... H05B 7/101

[52] U.S. Cl. ..... 13/15; 174/74 R

[58] Field of Search ..... 13/1, 9, 9 ES, 14–17; 174/74 R; 339/275 T, 278 T; 313/335, 331; 29/25.15, 25.17

[56] References Cited

U.S. PATENT DOCUMENTS

| | | | |
|---|---|---|---|
| 3,187,079 | 6/1965 | Pestel | 13/15 |
| 3,215,974 | 11/1965 | Wooding | 13/16 X |
| 3,311,693 | 3/1967 | Hauff et al. | 13/15 |
| 3,459,868 | 8/1969 | Schlienger | 13/14 X |

*Primary Examiner*—R. N. Envall, Jr.

*Attorney, Agent, or Firm*—Ewan C. MacQueen

[57] ABSTRACT

An electrode for electroslag remelting is provided by combination of an ingot having a toe end with an essentially flat outer annular surface and a central protrusion together with a current-carrying stub bridging across the central protrusion and welded to the flat portion of the ingot toe end on opposite sides of the protrusion such that metal wastage and surface preparation costs for stub-to-ingot welding are avoided.

4 Claims, 3 Drawing Figures

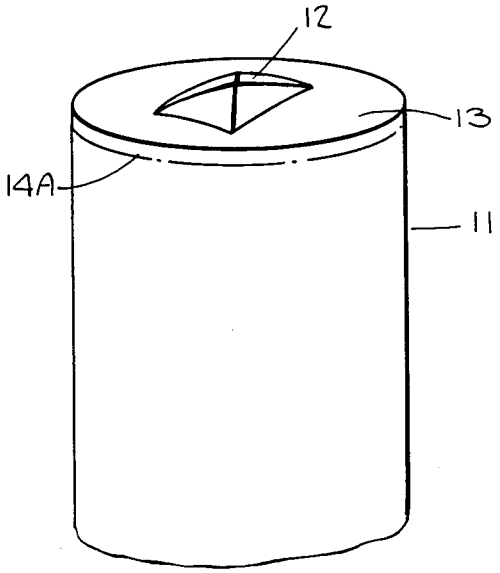
Fig. 1.
Fig. 2.
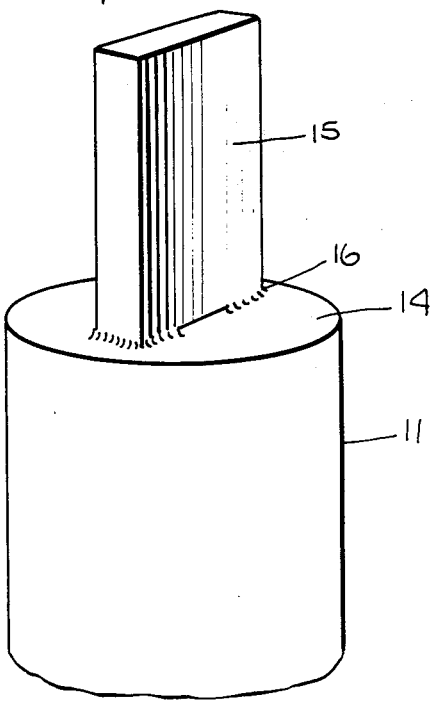
Fig. 3.
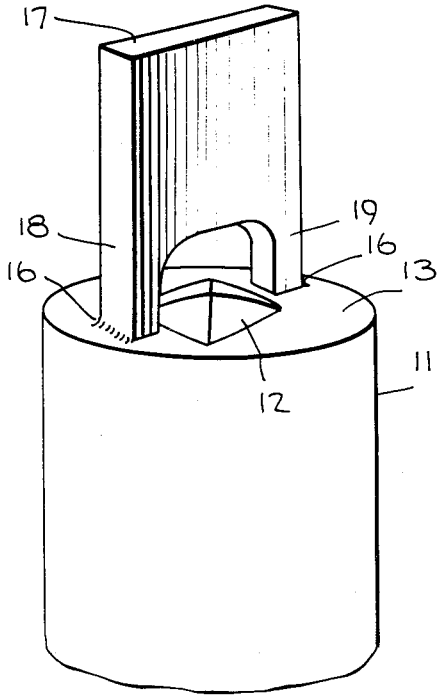

STUB DESIGN FOR ESR ELECTRODES

The invention is directed to provision of an electrode for electroslag remelting having a cast portion for remelting characterized by substantially reduced preparation costs.

BACKGROUND OF THE INVENTION

The production of metal ingots by the electroslag remelting (ESR) process is now well established, particularly in relation to alloys such as nickel-base alloys, stainless steels, tool steels, etc. where metal cleanliness is especially important. The ESR process comprises providing a mold, which may be water-cooled, may be open at each end and is usually clamped to a stool so as to complete the mold structure. To initiate remelting, a molten slag is introduced into the bottom of the mold and a consumable electrode is introduced into the molten slag usually with power on. Conductivity of the slag is such that passage of melting current in the electrode-mold circuit through the slag promotes rapid heating and surface melting of the electrode. Molten metal droplets from the electrode drop downward through the molten slag and collect in the bottom of the mold to form a new remelt ingot as melting of the consumable electrode proceeds. The ingot size producible by ESR has considerable latitude and ingots of 60 inches diameter and greater are produced commercially at present.

The consumable electrode must, of course, be initially provided, usually by casting as an ingot. The ingot to form the electrode is itself a heavy metal piece. For example, in one commercial installation, a 34 inch diameter cast electrode is employed in producing a 40 inch diameter ingot by ESR.

It is of course necessary to establish an electrical connection to the electrode, since a holder or arbor of standard size is provided in the ESR furnace to hold the electrode. Since the electrode will usually be large, a metal stub is usually fastened to one end of the electrode, as by welding or other suitable means. Generally, the stub is a metal piece of heavy rectangular section. In order to provide a good weld connection between stub and electrode, it has been the practice to cut off an end of the ingot intended to form the electrode as by sawing, machining, etc. to provide a planar surface matching a planar surface of the stub. Since a large piece of metal is involved, metal wastage and high cutting or machining costs are entailed. Thus, in a commercial installation, annual costs amounting to $90,000 were encountered as a result of the cutoff operation.

The problem and the invention are illustrated in the drawing wherein

FIG. 1 illustrates the toe end of an ingot for use as electrode for electroslag remelting;

FIG. 2 illustrates the top end of an electrode for electroslag remelting with stub attached; and FIG. 3 illustrates the top end of an electrode for electroslag remelting provided in accordance with the invention.

The problem is illustrated in FIG. 1 of the drawing which shows the toe end of ingot 11 produced by a conventional top-pour ingot casting operation to produce an ingot intended for use as an electrode in the ESR process. Ingot 11 is shown to be round in section, although other ingot cross-sectional shapes could be used for the intended purpose. In pouring the ingot, the round open-ended ingot mold is placed on a stool which is essentially flat but which is provided with an initial depression in ghe central portion thereof to control metal splash during pouring. Repeated use of the mold stool causes erosion of the stool surface resulting in growth of the central depression therein. The ingot cast against the stool accordingly will have a protrusion or hump corresponding to the depression in the mold stool against which the ingot is cast. The protrusion or hump is illustrated at 12 in the drawing. However, the annual area illustrated at 13 in FIG. 1 which surrounds the central protrusion or hump tends to remain reasonably flat despite erosion effects on the ingot stool during use. It is desirable to attach the electrode stub to the toe end of the ingot to form the completed electrode since the toe end metal is generally sounder than the metal in the head end portion of the ingot. Thus, pipe can occur at the head end which is harmless for purposes of remelting, but which makes the head end contour irregular, thus rendering attachment of the stub by welding or other means a difficult operation.

FIG. 2 of the drawing depicts a conventional electrode comprising ingot 11 having a planar face 14 produced by sawing off the toe end of ingot 11 and having a heavy metal stub 15 attached thereto by welds 16. Reference to FIG. 1 of the drawing illustrates by broken line 14A the location of the saw cut to provide planar face 14 shown in FIG. 2. Sufficient weld metal is employed to limit the current applied to the weld during melting such that the current does not exceed about 2,000 amperes per square inch of weld. In this way, melting of the weld with burn away of the stub during the ESR process is avoided.

It is to be appreciated that a bottom poured ingot will have a central gate in the stool for passage of molten metal upward into the ingot and that a central protrusion will occur at the ingot toe end although the protrusion will have a different contour than that illustrated in FIG. 1 of the drawing.

THE INVENTION

In accordance with the invention, the stub to be attached to the toe end of the ingot is made with one end forming a bridge, i.e., an end of the stub is provided with a central relief defined by equally extending legs having at the ends thereof planar faces falling in the same plane so that connection to the toe end of the ingot can be made by welding to the outer, essentially annular planar face thereon without contact to the central protrusion or hump. Thus, no mechanical operation is required on the toe end of the ingot to provide a complete planar face thereon prior to attachment of the stub and a satisfactory connection can be made between the stub ends and the planar surface of the as cast ingot by welding so as to provide a satisfactory electrode for the ESR process.

The foregoing is illustrated in FIG. 3 of the drawing wherein ingot 11 is again shown as being round in section and wherein on the toe end of the ingot itself, the central protrusion or hump 12 is again shown as in the outer planar face 13. Bridging stub 17 having two equally extending ends 18 and 19 welded to ingot toe planar face 13 by welds 16 are depicted in FIG. 3. The central relief between stub ends 18 and 19 is sufficient to clear protrusion 12 and no difficulty is experienced in welding stub ends 18 and 19 to planar face 13 beyond minor conditioning of the surface areas to which stub ends 18 and 19 are to be attached by welding. The stub itself may be made of mild steel, an alloy containing nominally 32% nickel, 20% chromium, balance iron, a stainless steel, etc.

EXAMPLE

A round ingot of an alloy of the type 65%Ni, 32%Cu, 1%Fe, 34 inches in diameter and weighing 38,000 pounds was top poured in an ingot mold having a flat stool provided with a central depression essentially of an irregular cone in contour with a depth of about 6 inches and with a base of about 17 inches long at the junction with the toe end surface. The resulting ingot had a flat toe end with a conical protrusion having an irregular base about 17 inches long and a height of about 6 inches. A stub made of the type 32%Ni, 20%Cr, bal. Fe alloy about 6 inches thick, 32 inches wide and 48 inches long was cut at one end to form two extending legs having end faces in the same plane with end faces being 6 inches by 4 inches defined by a cut out area about 12 inches by 28 inches therebetween was prepared. The toe end surface of the ingot was prepared for welding by wire brushing. The stub bridged across the roughly parallel sides of the toe end protrusion and was welded to the flat portion of the toe end using a filler metal containing essentially 3%Al, 1%Ti, bal. Ni to provide about 40 square inches of weld. The stub was then fitted to the current supplying arbor of the ESR furnace and was used to produce an ESR ingot with high recovery of electrode metal. The flux employed was of the spar, lime and alumina type.

Although the present invention has been described in conjunction with preferred embodiments, it is to be understood that modifications and variations may be resorted to without departing from the spirit and scope of the invention.

I claim:

1. A consumable metal electrode for electroslag remelting comprising an ingot having a toe end having an essentially flat surface at the junction of said toe end surface and the longitudinal wall of said ingot and characterized by a protrusion in the center portion of said toe end surface, said electrode having a current-carrying stub welded to opposite sides of said toe end surface and being relieved to clear said protrusion in said toe end surface.

2. An electrode according to claim 1 wherein said ingot is round and wherein the flat portion of said toe end surface is essentially annular.

3. An electrode according to claim 2 wherein said stub is essentially rectangular in section.

4. An electrode according to claim 3 wherein sufficient weld metal is deposited at the junction of said stub and the flat portion of said ingot toe end section to carry the current passed to said electrode in use to prevent overheating of said junction.

* * * * *